United States Patent [19]

Buehler

[11] 3,985,177

[45] Oct. 12, 1976

[54] METHOD FOR CONTINUOUSLY CASTING WIRE OR THE LIKE

[76] Inventor: William J. Buehler, 10613 Montrose Ave., Bethesda, Md. 20014

[22] Filed: Jan. 20, 1975

[21] Appl. No.: 542,300

Related U.S. Application Data

[63] Continuation of Ser. No. 788,135, Dec. 31, 1968, abandoned.

[52] U.S. Cl. ..... 164/51; 164/80; 164/82; 164/68; 164/119

[51] Int. Cl.[2] ..... B22D 27/02

[58] Field of Search ..... 164/80, 82, 122, 125, 164/127, 50, 51, 250, 251, 274, 76, 68, 119

[56] References Cited

UNITED STATES PATENTS

| | | | |
|---|---|---|---|
| 2,242,350 | 5/1941 | Eldred | 164/125 X |
| 3,174,851 | 3/1965 | Buehler et al. | 75/170 K |
| 3,508,914 | 4/1970 | Buehler | 164/51 UX |
| 3,529,958 | 9/1970 | Buehler | 75/170 X |
| 3,598,168 | 8/1971 | Clark | 164/51 |

FOREIGN PATENTS OR APPLICATIONS

| | | | |
|---|---|---|---|
| 440,859 | 1/1936 | United Kingdom | 164/251 |
| 1,013,851 | 12/1965 | United Kingdom | 164/51 |

*Primary Examiner*—Ronald J. Shore
*Attorney, Agent, or Firm*—Craig & Antonelli

[57] ABSTRACT

A method and apparatus for continuously casting molten TiNi-base alloys into relatively small wire or relatively flat ribbon shapes by the use of a graphite crucible structure directly adjoined by a metal die body having a shape-forming orifice; the alloy is melted in the crucible within a non-contaminating atmosphere, for example, vacuum, utilizing the graphite crucible as susceptor for the TiNi-base alloy, and the molten metal is forced through the shape forming orifice of the metal die body while the latter is cooled; the thus cast alloy is continuously removed from the die.

38 Claims, 6 Drawing Figures

FIG.3
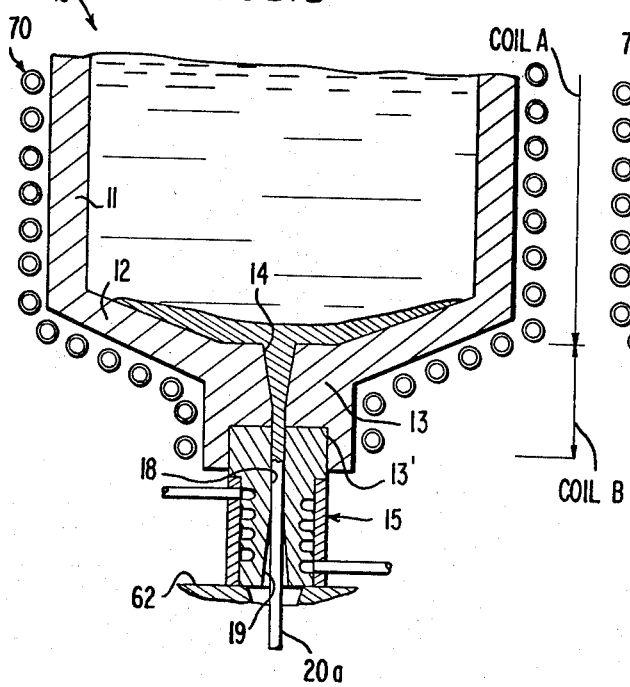
FIG.4
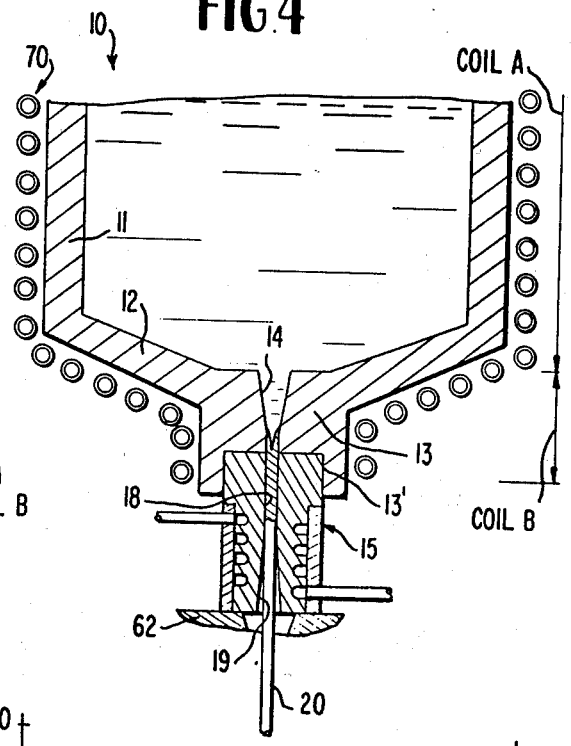
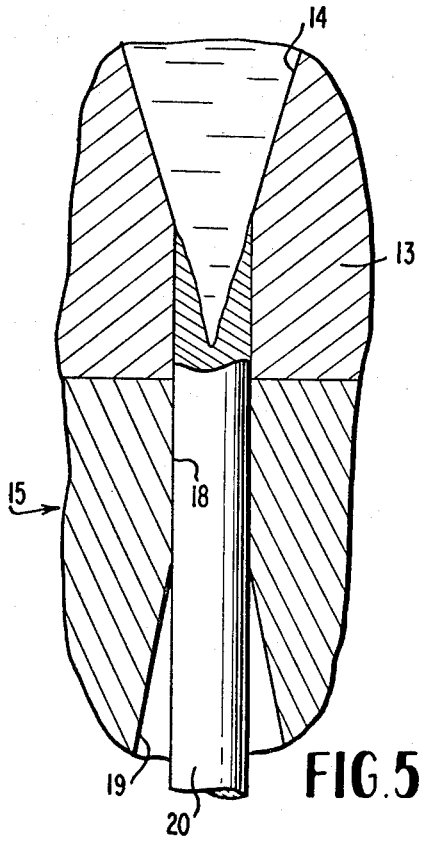
FIG.5
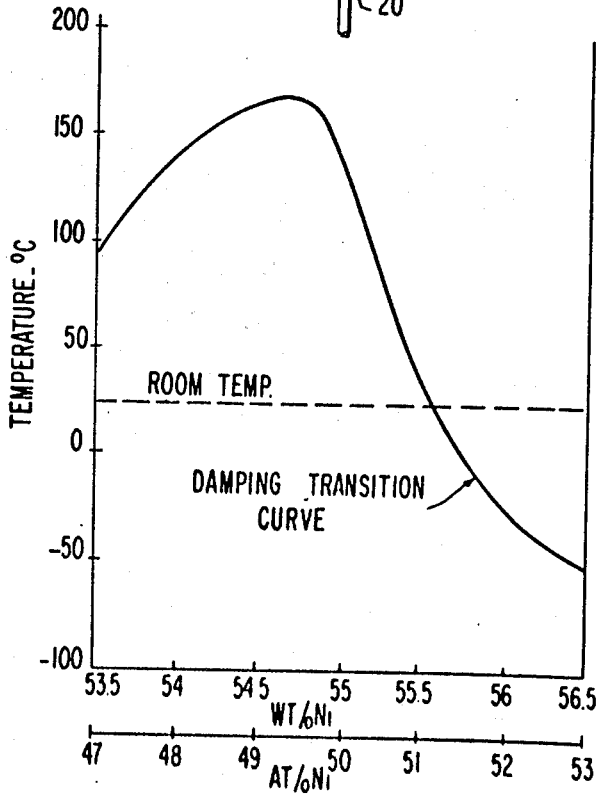
FIG.6

METHOD FOR CONTINUOUSLY CASTING WIRE OR THE LIKE

This application is a continuation application of Ser. No. 788,135 filed Dec. 31, 1968, now abandoned.

The present invention relates to a method and apparatus for continuously casting wire or the like, and more particularly to a method and apparatus for continuously casting a wire or the like essentially consisting of a TiNi base-alloy.

In particular, the near stoichiometric TiNi alloys possess unique characteristices and can be drawn into wire (U.S. Pat. No. 3,174,851). Heretofore, such near-stoichiometric TiNi wire products were made by first making TiNi alloy, casting the molten alloy into ingot shape, thereupon hot-rolling the cast ingot into a bar, hot-swaging the bar into a rod and thereafter wire-drawing the rod. However, such prior art method of making TiNi wire is relatively uneconomical and does not permit continuous production of the wire in any desired length.

Continuous casting methods of copper-base-type alloys are known in the prior art (U.S. Pat. No. 2,136,394 and 2,782,473). However, these methods and apparatus are not suitable for continuously casting a wire of a TiNi alloy, containing approximately 45% by weight of titanium, which in its elemental form is normally highly reactive, in particular with graphite.

It is also known in the prior art (U.S. Pat. No. 3,189,957) to use a crucible and die of ceramic material in connection with a method for solidifying in a directional manner "Alnico" permanent magnets. However, the method and apparatus of this patent would also be unsuitable for continuously casting a wire or the like made from a TiNi base-alloy.

Finally, it is also known in the prior art (U.S. Pat. No. 2,814,560) to purify reactive elemental metals such as zirconium, titanium and hafnium. However, the refractory furnace and the solidifying collar made from Cu as well as the whirling action caused by the inert gas would not be suitable for continuously producing any composition-controlled alloys, particularly for continuously casting TiNi base-alloys of the type in question.

The present invention seeks to obviate the shortcomings of the prior art and to provide a method and apparatus by means of which TiNi base-alloy wire can be directly cast and processed in an economical way into a finished wrought wire with shape-recovery properties similar to the same composition wire made by the conventional methods.

The method according to the present invention consists in melting and alloying a near-stoichiometric TiNi composition alloy of controlled transition temperature in a graphite crucible and thereupon continuously casting the desired diameter wire by applying a pressure head on the molten alloy, sufficient to displace the molten material through a die while solidifying, and thereafter further reducing the wire diameter by wire-drawing the same at room temperature while annealing the wire between passes through the wire-drawing dies until the desired diameter is obtained, whereupon the wire may be finally annealed, if so desired.

The apparatus in accordance with the present invention comprises a graphite crucible with a graphite die-body, adjoined by a water-cooled die-body, for example, of molybdenum; heating coils connected to a conventional high-frequency source are placed about the graphite crucible and graphite die-body in predetermined sections to provide the necessary selective heat control for the alloy to remain in molten condition in the crucible and at predetermined temperature during its passage through the graphite die-body. Additionally, an inert gas such as argon or helium may be supplied to a gas diffuser at the outlet of the water-cooled die-body to prevent excessive oxidizing of the thus-cast wire. In the alternative or in addition, an oxidizing agent may also be used with a diffuser if it becomes desirable to provide a predetermined oxide layer on the cast wire, for example, to facilitate wire-drawing.

The present invention offers several advantages over the prior art. In the first place, it permits continuously casting a relatively small diameter wire containing approximately 45% by weight of Ti which would normally be a highly reactive element. Additionally, the present invention obviates the rolling and swaging operations necessary heretofore in connection with converting an ingot of the alloy into a wire, thereby also avoiding the need of costly machinery.

By being able to melt the alloy in a graphite crucible which represents excellent susceptor characteristics, it is possible to control the alloy temperature with sufficient precision in the crucible and in its passage through the graphite die-body to allow the formation and solidification of the wire.

Furthermore, the present invention offers the salient advantage that it is possible to directly cast the molten alloy into a small diameter wire which requires thereafter minimal processing into finished wrought wire with properties comparable to conventionally processed wire.

These and further objects, features, and advantages of the present invention will become more obvious from the following description when taken in connection with the accompanying drawing which shows, for purposes of illustration only, one embodiment in accordance with the present invention, and wherein:

FIG. 3 is a partial cross-sectional view through the crucible in accordance with the present invention, illustrating schematically the purpose action during the melting phase;

FIG. 4 is a partial cross-sectional view through the crucible and die in accordance with the present invention, illustrating the effect of the heating coil B and providing differential pressure;

FIG. 5 is a partial cross-sectional veiw, on an enlarged scale, and schematically illustrating the feeding and solidification of the cast alloy wire in accordance with the present invention; and FIG. 6 is a diagram illustrating the relationship of transition temperature of a TiNi base-alloy as a function of the proportion of Ti and Ni percentage per weight in the alloy.

Figure 1:
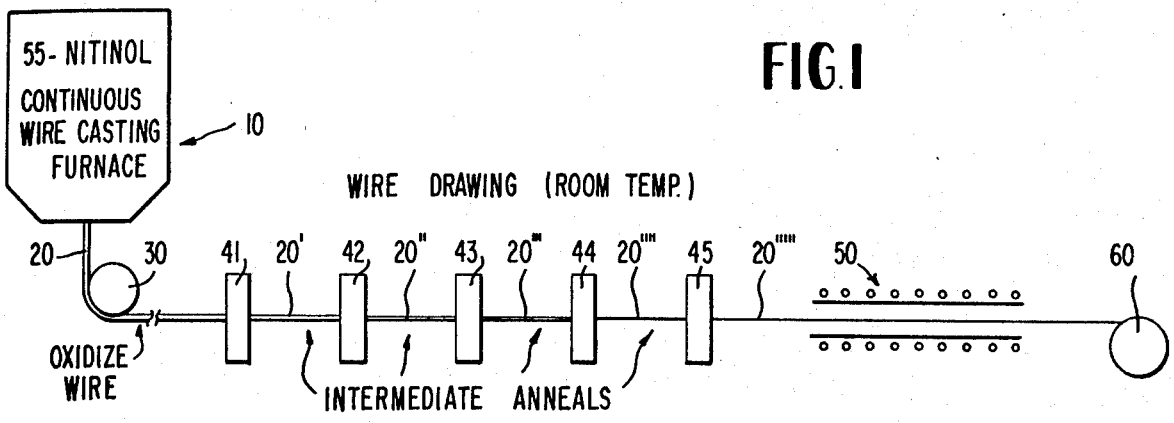
FIG. 1 is a schematic, diagrammatic view illustrating the process of continuously wire-casting a TiNi alloy wire in accordance with the present invention.

Referring now to the drawing wherein like reference numerals are used throughout the various views to designate like parts, and more particularly to FIG. 1, reference numeral 10 generally designates the wire-casting furnace equipment consisting of an assembled crucible and die structure which produces at its output the cast wire generally designated by reference numeral 20 that is drawn, after coiling or spooling on a spool 30 to a desired length and then passed through a suitable number of wire-drawing dies 41, 42, 43, 44 and 45 of any conventional construction and providing wire reductions by desired, predetermined amounts depending on die design, wire diameter, fibered texture and speed of advance. In a practical sense the normal speed of drawing would probably require the continuously cast wire from furnace 10 to be coiled on a spool at 30. Then a length of coiled wire from 30 would be drawn. Note break in FIG. 1.

Between passes through the wire-drawing dies 41, 42, 43, 44 and 45, the initially cast and subsequently drawn wire is annealed by conventional means. Since such annealing means are known per se and form no part of the present invention, they are indicated only schematically and a detailed description thereof is dispensed with herein. For example, furnace annealing in an air atmosphere, electric resistance heating, induction heating, oxy-acetylene torch or immersion in a heated bath (e.g., Wood's metal, appropriate fused salt, etc.) may be used for annealing purposes. The wire 20, which is designated after successive passages through the dies 41, 42, 43, 44, 45, etc. by reference numerals 20′, 20″, 20‴, 20⁗, 20′⁗′, etc. respectively, may be finally annealed by conventional annealing means generally designated by reference numeral 50, again forming no part of the present invention and therefore not described herein in detail, before the wire is wound on a roll 60 or other suitable means for storage purposes.

The continuous wire casting furnace generally designated by reference numeral 10 which includes a graphite crucible 11 (FIG. 2), is suitably mounted in any conventional manner, for example, is held against an upper pressure plate 60 by means of suitable spring forces 61 of any conventional type applied against the lower pressure plate 62. The graphite crucible 11 which may be, for example, of circular, square or other appropriate cross-sectional configuration includes a slightly slanting bottom 12 adjoined by the graphite die body 13 in its center. The graphite die body 13 is provided with a hole 14 of tapering configuration that is variable for the desired wire size. The graphite die body 13 is recessed at 13′ to receive the water-cooled die body structure generally designated by reference numeral 15 which is of complementary configuration in its upper part so as to be accommodated in the recess 13′ and thereby form an interface 15′ with the graphite die body 13. The water-cooled die-body 15 is suitably secured to the graphite die body 13 and its lower part rests against the lower pressure plate 62. The die structure 15 is water-cooled by any conventional means, for example, by means of a spiral passage 16 having an inlet 16′ for the cooling water and an outlet 16″. The cooling water passages 16 are closed off against the outside in a conventional manner, for example, by means of a jacket 17.

The die-body 15 is provided with a central hole or aperture consisting of an upper portion 18 of substantially constant diameter and of the same dimensions as the outlet diameter of the hole 14 in graphite die body 13, and of the lower portion 19 which tapers in the opposite direction from the hole 14. An aperture 63 is effectively formed within the lower pressure plate 62 by the gas diffusor generally designated by reference numeral 64 and of any conventional construction to which is supplied an inert and/or oxidizing gas, as desired by way of line 65. Sections 11 and 13 can be one single continuous unit, as shown in FIGS. 2, 3, 4 and 5, or alternatively, section 13 could be "pressure fitted graphite die." The latter replacement capability would provide (1) easy change of die size and (2) easy repair or replacement of worn graphite dies. The graphite crucible 11 and graphite die-body 13 are surrounded by high-frequency heating coils generally designated by reference numeral 70 which is subdivided into a suitable number of sections, for instance, into coil section A surrounding the crucible 11, properly speaking, and into the coil section B surrounding the graphite die-body 13 to provide independent temperature control as will be explained more fully hereinafter.

Instead of molybdenum, tungsten may also be used for the material of the water-cooled die structure 15 although molybdenum is preferred because of its lower cost and because it tolerates a high heat and can be water-cooled without any problem.

Figure 2:
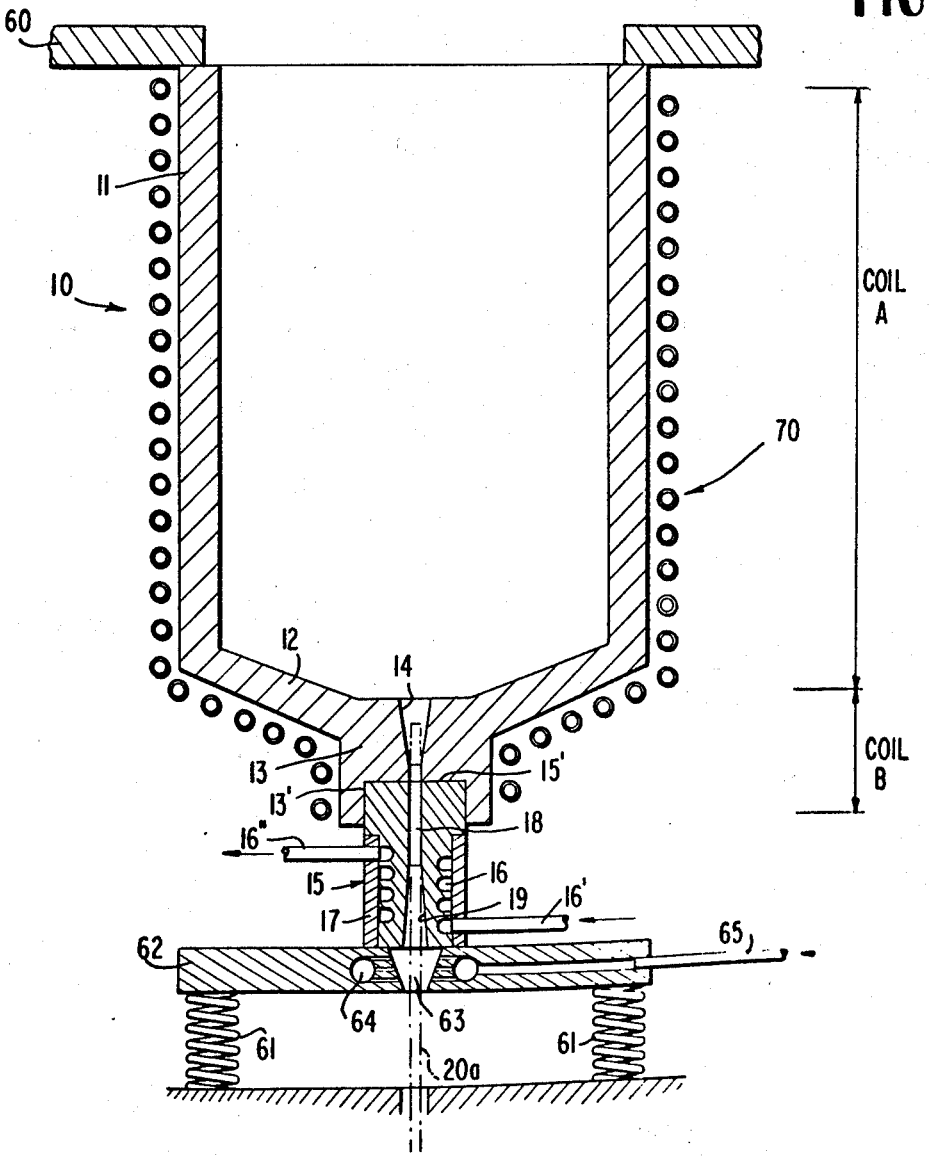
FIG. 2 is a somewhat schematic cross-sectional view through a crucible and wire-solidification die in accordance with the present invention.

The method according to the present invention involves the following steps:

A. Melting and alloying a near TiNi composition or cobalt-substituted TiNi ternary alloy of controlled transition temperature in the graphite crucible 11. This may be achieved in several ways:

1. Initially melting the alloy as disclosed in U.S. Pat. No. 3,174,851 and casting the same in ingot form of predetermined shape; the ingot is then placed into crucible 11 and melted by induction heating; or 2. Melting the alloy in accordance with the preferred technique as described in U.S. application Ser. No. 592,069, now U.S. Pat. No. 3,529,958, by employing a graphite crucible. The melted alloy is then cast in a suitable mold, whereby the final solidified ingot will be preferably cast in a shape to fit the cross section of the graphite crucible 11 of FIG. 2; the ingot is then again placed into crucible 11 and melted by induction heating; or 3. Placing at first a stop-plug of appropriate TiNi base alloy composition in the wire-forming orifice 18, 19 at the bottom of the crucible 11 as shown in FIG. 2 in dash and dotted lines and designated by reference numeral **20*a*. The graphite crucible 11 is then used as a container for preparing the near TiNi composition alloy. After complete alloying and mixing of the molten alloy, a solid "skull" is permitted to form at the bottom as shown in FIG. 3 by water-cooling the wire-forming die-body 15 (FIGS. 2 and 4), which in turn will chill the lower portion of the graphite die body 13.**

B. For the purpose of continuously casting the desired diameter (cast) wire, a charge of suitable composition TiNi alloy is placed in the crucible 11. If the charge is molten, it appears as shown in FIG. 3 with a solid skull welded to the wire plug **20*a* in the wire-forming orifice. This wire plug acts in two ways; firstly, it plugs the orifice 14, 18, 19 and secondly, it can be used, if welded to the skull, to anchor the skull so that it will not float out of position. If the charge in the crucible 11 is a solid cast ingot, it must first be made molten. This is accomplished by plugging the wire orifice aperture 14, 18, 19 and then melting the ingot. Power will be supplied in the form of high-frequency energy from both coils A and B as shown in FIGS. 2 and 3. When the alloy is molten and stirred, the current flow may be stopped in coil B to form a skull as shown in FIG. 3** or the continuous wire casting operation may begin which then includes the following steps:

1. A pressure head is applied on the molten alloy, now homogeneous due to the stirring action in the crucible 11, coil B is energized to melt the skull, then under a pressure which is sufficient to displace the solid wire stop plug 20*a* in the water-cooled die-body 15 to start the operation. The pressure head may be realized in several ways, for example, by applying an inert gas to the upper portion of the chamber of the crucible 11, constructed in a gas-tight manner for that purpose. In the alternative, a mechanical ram may be used or, preferably, the weight of the charge in the crucible 11 will be used to act directly as pressure head. Once the wire plug 20*a* is displaced, it is only necessary to apply a sufficient pressure to continue the feed of the molten alloy through the die-body 13, 15 to effect continuous wire casting.

2. The melt temperature, i.e., power input to coils A and B, cooling water flow in the water-cooled wire die-body 15, hydrostatic pressure on TiNi melt, etc., depend on various factors, such as, size of the cast wire diameter, etc., and can be readily determined empirically for each given condition.

3. Once a steady flow of continuously cast wire is established, as shown in FIG. 5, it only remains to maintain these optimum conditions until the complete melt is converted into cast wire. To maintain optimum steady state flow requires some physical variation, such as a change in the power input to the coil A, a change in the hydrostatic pressure on the alloy as well as a change in the power input to the coil B.

4. In connection with the continuous casting mechanism as shown in FIG. 5, the molten alloy is shown as being completely solidified in the graphite die-body portion 13. While this is preferred, it is not absolutely necessary since no alloying between the molten TiNi (nominal 55-Nitinol) and a chilled molybdenum die may occur. In the event of solidification in the graphite die-body portion 13, two further precautions may be required; namely, the use of graphite die inserts to replace worn graphite die orifices and a greater die opening clearance in the molybdenum die 15 to prevent possible jamming.

5. As the cast wire 20 comes out of the lower end of the molybdenum die orifice 19, it is still sufficiently warm to allow slight oxidation of its surface as it passes through the gas diffuser 64, dispensing air or oxygen (FIG. 2). If the wire is small in cross section and does not remain hot enough to be oxidized, it may be preferably oxidized by conventional means before drawing as shown in FIG. 1.

6. The continuously cast TiNi wire 20, as it issues from the wire casting unit 10, is sufficiently ductile, particularly below its transition temperature, to be coiled for storage, shipping etc. In the alternative, it may be processed directly as shown in FIG. 1 into cold-drawn and annealed wire, ready for use in varied applications, but the speeds of drawing would have to be adjusted to the rate of cast wire formation.

The limited composition range of the TiNi alloy can be explained by reference to FIG. 6 which illustrates the approximate transition temperature for various TiNi alloys, represented by the curve labeled "Damping Transition Curve". This curve indicates the critical temperature for each composition alloy below which the martensitic diffusionless transition can proceed readily under the forces of deformation. If the drawing operation is to be performed at only room temperature, it can be seen that the useful range is limited to about 0.5 to 1 atomic % (up to 0.5 per cent by weight) of nickel in excess of the stoichiometric TiNi composition, whereas on the titaniumrich side (not shown), alloys deviating by more than about 1.0% by weight in Ti from the stoichiometric composition will not draw into a wire. In the latter situation Ti in excess of about 1.0% by weight will cause the formation of some brittle second phase of $Ti_2Ni$. Lower temperature drawing below room temperature is possible for the nickel-rich alloys and those with cobalt substitutions, e.g., $TiNi_x$-$Co_{1-x}$ (U.S. Application Ser. No. 579,185 filed on Sept. 9, 1968, by Wang et al.) by chilling the wire and die below the transition temperature (damping transition curve) during drawing.

The reduction in the wire for each pass may be of the order of 10% to 20% (area reduction) between anneals; the possible area reductions are greater in a small diameter wire due to the prior wire drawing operation. The preferred annealing temperature during drawing is about 700° to 800° C., depending on the particular alloy composition. The optimum temperature and time at temperature can be readily determined by merely bending the annealed wire between one's fingers to determine if the wire feels soft and pliable. If it is very pliable, then the anneal has been successful whereas if it retains part of all of the drawn stiffness, a higher annealing temperature or longer time at temperature will be required. Additionally, annealing temperatures of 400° to 450° C. may even be sufficient to promote softening, for example, in connection with an alloy of 55.1% by weight of Ni, the remainder essentially Ti. However, the temperatures should not exceed 800° C., particularly with small diameter wires, because of the rapid diffusion of oxygen into the alloy and its detrimental and damaging effect.

The annealing time is dependent upon the martensitic transition rather than the normal recovery and re-crystalization. Consequently, the annealing time is dependent only upon heating of the material through and above a critical threshold temperature which may be only a matter of seconds in the case of wire.

Prolonged heating should be avoided to prevent undue oxidation. If resistance-heating is used, copper slide contacts may be placed along the travel of the wire with appropriate contact pressure and power setting to attain the proper annealing temperature depending upon the rate of wire travel and diameter thereof.

Any number of lubricants such as thick soap solutions, coconut oil, sulfanated tallow, oil dag, etc., appear equally well suited for the die lubrication purposes, the only criteria for their selection being their ability not to contaminate the alloy or either of the elements comprising the alloy. For drawing alloys with a transition temperature above room temperature and slightly below room temperature, ordinary lanolin has proved an excellent lubricant.

The oxide may be removed from the wire in any conventional manner; for example, by mechanical abrasion or chemical means such as immersion in a solution of 50% by volume of HF (concentrated) +50% by volume of $HNO_3$ (concentrated). However, it is recommended that only the loose oxide be removed, preferably mechanically and that a definite oxide film be allowed to remain on the wire which assists the smooth drawing operation. Such oxide film can be stripped after final annealing.

Where it is desired to use the TiNi wire for high strength tensile applications, it may be desired to leave the wire in the "as drawn" condition. However, for many applications requiring optimum mechanical energy storage, dimensional activity and vibration attenuation, it is necessary to provide a post-drawing anneal which is performed in an air atmosphere between 400° and 800° C., depending upon the alloy composition and the intended use. If the wire is to be absolutely nonmagnetic, it should be chemically pickled in the $HF+HNO_3$ solution after the post-drawing anneal or should be annealed in the high purity inert protected atmosphere such as argon, helium, etc.

The drawing rate is determined to a large measure by the heat generated during the drawing and the critical transition temperature of the alloy since the rate of drawing should be kept in line with the die and wire cooling capabilities.

The following example indicates a typical operation of the method in accordance with the present invention.

A high purity graphite crucible is charged with prealloyed near-TiNi composition ingot. This ingot was melted and cast preferably in accordance with the teachings of U.S. application Ser. No. 592,069, now U.S. Pat. No. 3,529,958, into a shape so that it would fit the contour of the graphite crucible 11 and 12. At this time, a wire of near TiNi composition of suitable diameter to completely fill the orifice 18 is inserted from the bottom through the tapered die portion 19. This wire stop plug is inserted upward until it makes contact with the solid ingot. When this contact is made the wire is appropriately clamped below by means of support 62 to insure that it will remain in position during the initial stages of melting. Next cooling water is passed through coils A and B and the molybdenum die body 15. The chamber (not shown) encompassing the unit, both above and below support 62, is pumped to a low pressure (10 microns). Following this, power is supplied to coil A, the power supplied to coil A will cause a predominant portion of the TiNi ingot to melt and allows liquid alloy to flow down into the tapered graphite orifice 14 and fuse to the wire stop plug previously inserted.

The control of power in coils A and B is adjusted by conventional means to cause the melting and fusing. At this point in the cycle, the temperature of the melt is accurately determined by an immersion thermocouple placed in the cone near the entrance to the tapered orifice 14. The thermocouple is encased in a suitable graphite protection tube. The thermocouple is maintained in this position during the entire run. The super heat of the melting alloy can vary upon many factors, e.g., cast wire size, thermal gradient in graphite die 13, etc. Further the melting point of a heat will vary with composition but tends to be in the range around 1300° C. Power is also supplied to coil B to keep the molten alloy in the tapered orifice 14 molten but with very little superheat over what is required to just keep the alloy molten similar in composition to the larger portion of the melt in crucible 11. This graphite die temperature may be monitored by a thermocouple inserted in the die body 13.

When a thermal steady state is attained with proper temperature gradient in the graphite die 13, a slight positive pressure differential is produced on the molten alloy above the pressure plate 62.

This is accomplished by bleeding in an inert gas of either argon or helium. The pressure build-up must be subtle and very gradually applied. This latter action will cause the cast wire to be expelled at 19 and through 63. The rate at which the wire is cast is a function of (i) graphite die temperature gradient, (ii) melt temperature, (iii) length of graphite die section 13 and (iv) water cooled efficiency of the molybdenum die 16.

Once casting operation is initiated, it is highly important to maintain all conditions of temperature, pressure differential, etc. to insure uniform wire production. Some abrasion of the graphite die body 13 may be encountered but the minor variations in cast wire diameter are rectified during initial passes in the wire drawing operation.

Replacement graphite dies 13 may be required heats to maintain close dimensional tolerances on the wire diameter. While pyrolytic graphite die bodies 13 have not been employed, some heat transfer advantages might arise from the anisotropic nature of this unique material.

During casting it may be necessary to bleed in small amounts of argon, helium or one of these inert gases mixed with oxygen to assist in maintaining the proper pressure differential above and below pressure plate 62. Also the oxygen, if used, is added to lightly oxidize the wire surface and improve its subsequent wire drawing capability. If the cast wire is small in diameter the oxygen treatment is useless since the wire temperature will be too low when it arrives in the diffuser zone 63. This latter wire will require some form of reheating in an air atmosphere to oxidize its surface prior to wire drawing.

Since conventional controls are used, it is only necessary for the operator to follow the steps described above to adjust the temperature, etc., in order to establish the necessary conditions for continued casting operations by thereafter maintaining these conditions subject to the minor adjustments, from time to time, mentioned above.

The advantages of the present invention are obvious since it permits the continuous casting of a relatively small diameter wire containing approximately 45% by weight of titanium.

An additional feature of the present invention is to be able to melt in a graphite crucible which constitutes a good susceptor in order to control the alloy temperature with such precision as to allow formation and solidification of the wire as shown in FIG. 5. Normally, few medium temperature structure alloys are sufficiently inert in graphite, and certainly the iron base alloys and nickel-base alloys are completely reactive with graphite.

A further feature of this invention resides in directly casting the small diameter wire of near stoichiometric TiNi composition which requires minimal processing into finished wrought wire with properties comparable to conventionally processed wire.

Tests of the bend-heat-recovery of a continuously cast wire in accordance with the present invention indicated a performance comparable to wire processed by the more costly conventional prior art technique described hereinabove. A microstructure analysis also indicates that a minimum of about 75% area reduction, from cast wire to wrought finished wire, is required to yield comparable performance and proper interstitial dispersion in the TiNi-phase matrix. However, this figure varies with diameter, time, temperature, soaking periods, temperature of intermediate anneals, etc. though it serves as a guideline for successfully carrying out the method of the present invention.

While I have shown and described only one embodiment in accordance with the present invention, it is understood that the same is not limited thereto but is susceptible of numerous changes and modifications as known to a person skilled in the art, and I therefore do not wish to be limited to the details shown and described herein, but intend to cover all such changes and modifications as are within the scope of those skilled in the art. For example, instead of wire shape, the wire can be cast in flat strip shape or the like.

I claim:

1. A method for continuously causing molten TiNi-base alloys having of the order of 55% by weight of Ni, into relatively small wire or relatively flat ribbon shapes by the use of a graphite crucible directly adjoined by a metal die body provided with a shape-forming orifice comprising the steps of melting the alloy in the graphite crucible within a non-contaminating environment utilizing the graphite crucible as susceptor for the TiNi-base alloy, cooling at least a part of the metal die body while forcing the molten alloy through its shape-forming orifice, and continuously removing the cast alloy from the die.

2. A method according to claim 1, characterized in that the step of melting the alloy in the graphite crucible takes place in an evacuated environment.

3. A method according to claim 2, characterized in that an inert gas is fed to the top of the molten alloy to force the molten alloy through the shape-forming orifice.

4. A method according to claim 1, in which the solidification die for the molten alloy consists of a graphite body and of the metal die body and in which the graphite crucible and graphite die body are heated while the metal die body is cooled.

5. A method according to claim 4, characterized in that the molten alloy is substantially completely solidified in the graphite die body.

6. A method according to claim 4, further comprising the step of reducing the heat applied to the graphite die body while controlling the cooling of the metal die body in such a manner that the alloy is substantially solidified in the metal die body while a temperature gradient is developed in the alloy from a point near the interface between said die bodies to the area of the alloy where it is still molten in the graphite die body.

7. A method according to claim 6, characterized in that a solid skull of said alloy is formed at the bottom of said crucible and a stop plug of said alloy is inserted into the orifice of the solidification die and is anchored to said skull, and thereafter the metal components of the alloy are charged into said crucible while simultaneously heating the same.

8. A method according to claim 4, wherein the alloy is melted by placing an ingot of said alloy into said container and applying heat thereto.

9. A method according to claim 4, wherein the alloy is melted in said crucible by initially forming a solid skull of said alloy at the bottom of the crucible, and thereafter charging the metal components of said alloy into said container while simultaneously heating the same.

10. A method according to claim 9, wherein a stop-plug of said alloy material is inserted into the orifice of the solidification die, and wherein said stop-plug is anchored to said skull.

11. A method according to claim 1, wherein the alloy is melted by placing an ingot of said alloy into said crucible and applying heat thereto.

12. A method applying to claim 1, wherein the alloy is melted in said crucible by initially forming a solid skull of said alloy at the bottom of the crucible, and thereafter charging the metal components of said alloy into said crucible while simultaneously heating the same.

13. A method according to claim 12, wherein a stop-plug of said alloy material is inserted into the orifice of the solidification die, and wherein said stop-plug is anchored to said skull.

14. A method for continuously casting molten TiNi-base alloys having of the order of 55% by weight of Ni, into relatively small wire or relatively flat ribbon shapes by the use of a graphite crucible directly adjoined by a metal die body provided with a shape-forming orifice of relatively small cross section comprising the steps of melting the alloy in the graphite crucible within a non-contaminating environment utilizing the graphite crucible as susceptor for the TiNi-base alloy, holding the melted alloy in its molten condition within said grapite crucible and in contact with said graphite crucible for a predetermined period of time to assure homogeneity of the molten alloy while in said graphite crucible, thereafter forcing the molten alloy through its shape forming orifice while cooling at least a part of the metal die body, and continously removing the cast alloy from the die.

15. A method according to claim 14, characterized in that the step of melting the alloy in the graphite crucible takes place in an evacuated environment.

16. A method according to claim 15, characterized in that an inert gas is fed to the top of the molten alloy to force the molten alloy through the shape forming orifice.

17. A method according to claim 16, in which the solidification die for the molten alloy consists of a graphite body and of the metal die body, and in which the graphite crucible and graphite die body and heated while the metal die body is cooled.

18. A method according to claim 17, characterized in that the molten alloy is substantially completely solidified in the graphite die body.

19. A method according to claim 17, further comprising the step of reducing the heat applied to the graphite die body while controlling the cooling of the metal die body in such a manner that the alloy is substantially solidified in the metal die body while a temperature gradient is developed in the alloy from a point near the interface between said die bodies to the area of the alloy where it is still molten in the graphite die body.

20. A method according to claim 17, characterized in that a solid skull of said alloy is formed at the bottom of said crucible and a stop plug of said alloy is inserted into the orifice of the solidification die and is anchored to said skull, and thereafter the metal components of the alloy are charged into said crucible while simultaneously heating the same.

21. A method according to claim 17, wherein the alloy is melted by placing an ingot of said alloy into said container and applying heat thereto.

22. A method according to claim 17, wherein the alloy is melted in said crucible by initially forming a solid skull of said alloy at the bottom of the crucible, and thereafter charging the metal components of said alloy into said container while simultaneously heating the same.

23. A method according to claim 22, wherein a stop-plug of said alloy material is inserted into the orifice of the solidification die, and wherein said stop-plug is anchored to said skull.

24. A method according to claim 17, wherein the alloy is melted by placing an ingot of said alloy into said crucible and applying heat thereto to first completely melt the ingot within said crucible and hold the same within said crucible for said predetermined time before forcing the molten alloy through said orifice.

25. A method according to claim 14, wherein the alloy is melted in said crucible by initially forming a solid skull of said alloy at the bottom of the crucible, and thereafter charging the metal components of said alloy into said crucible while simultaneously heating the same.

26. A method according to claim 25, wherein a stop-plug of said alloy material is inserted into the orifice of the solidification die, and wherein said stop-plug is anchored to said skull.

27. A method according to claim 14, characterized in that a solid skull of said alloy is formed at the bottom of said crucible and a stop plug of said alloy is inserted into the orifice of the solidification die and is anchored to said skull, and thereafter the metal components of the alloy are charged into said crucible while simultaneously heating the same.

28. A method for continuously casting molten TiNi-base alloys having of the order of 55% by weight of Ni into relatively small wire or relatively flat ribbon shapes by the use of a graphite crucible directly adjoined by a metal die body provided with a shape-forming orifice of relatively narrow cross section in relation to the volume of graphite crucible, comprising the steps of melting the alloy in the graphite crucible within a non-contaminating environment utilizing the graphite crucible as susceptor for the TiNi-base alloy, cooling at least a part of the metal die body, forcing the molten alloy through the relatively small cross section of its shape forming orifice so that only a small portion of the molten alloy in said crucible is permitted to pass through said orifice at any given time while the remaining portion of the alloy is held in molten condition in said crucible in contact with the graphite walls thereof, and continuously removing the cast alloy from the die.

29. A method according to claim 28, characterized in that the step of melting the alloy in the graphite crucible takes place in an evacuated environment.

30. A method according to claim 28, characterized in that an inert gas is fed to the top of the molten alloy to force the molten alloy through the shape forming orifice.

31. A method according to claim 28, in which the solidification die for the molten alloy consists of a graphite body and of the metal die body, and in which the graphite crucible and graphite die body are heated while the metal die body is cooled.

32. A method according to claim 28, characterized in that a solid skull of said alloy is formed at the bottom of said crucible and a stop plug of said alloy is inserted into the orifice of the solidification die and is anchored to said skull, and thereafter the metal components of the alloy are charged into said crucible while simultaneously heating the same.

33. A method according to claim 28, further comprising the step of reducing the heat applied to the graphite die body while controlling the cooling of the metal die body in such a manner that the alloy is substantially solidified in the metal die body while a temperature gradient is developed in the alloy from a point near the interface between said die bodies to the area of the alloy where it is still molten in the graphite die body.

34. A method according to claim 28, wherein the alloy is melted by placing an ingot of said alloy into said crucible and applying heat thereto.

35. A method according to claim 28, wherein the alloy is melted in said crucible by initially forming a solid skull of said alloy at the bottom of the crucible, and thereafter charging the metal components of said alloy into said crucible while simultaneously heating the same.

36. A method according to claim 35, wherein a stop-plug of said alloy material is inserted into the orifice of the solidification die, and wherein said stop-plug is anchored to said skull.

37. A method according to claim 28, characterized in that the molten alloy is substantially completely solidified in the graphite die body.

38. A method according to claim 28, characterized in that the volume of molten alloy in said graphite crucible is a large multiple of the volume of the alloy in the shape-forming orifice.

* * * * *